US011215017B2

(12) United States Patent
Borgfeld et al.

(10) Patent No.: US 11,215,017 B2
(45) Date of Patent: Jan. 4, 2022

(54) PERFORATING SHOCK PROTECTION FOR SENSORS

(71) Applicant: Schlumberger Technology Corporation, Sugar Land, TX (US)

(72) Inventors: Christine Borgfeld, Alvin, TX (US); Steven Matlock, Alvin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 246 days.

(21) Appl. No.: 16/066,193

(22) PCT Filed: Nov. 23, 2016

(86) PCT No.: PCT/US2016/063442

§ 371 (c)(1),
(2) Date: Jun. 26, 2018

(87) PCT Pub. No.: WO2017/116588

PCT Pub. Date: Jul. 6, 2017

(65) Prior Publication Data

US 2020/0270954 A1 Aug. 27, 2020

Related U.S. Application Data

(60) Provisional application No. 62/271,940, filed on Dec. 28, 2015.

(51) Int. Cl.
*E21B 47/017* (2012.01)
*E21B 17/07* (2006.01)
(Continued)

(52) U.S. Cl.
CPC ..... *E21B 17/07* (2013.01); *E21B 47/017* (2020.05); *E21B 43/116* (2013.01); *E21B 43/119* (2013.01); *E21B 47/06* (2013.01); *E21B 47/12* (2013.01)

(58) Field of Classification Search
CPC ..... E21B 47/017; E21B 17/07
See application file for complete search history.

(56) References Cited

U.S. PATENT DOCUMENTS 5,070,249 A * 12/1991 White ..... E21B 47/017 250/483.1
5,188,191 A * 2/1993 Tomek ..... E21B 17/07 175/321

(Continued)

FOREIGN PATENT DOCUMENTS

WO WO02090715 11/2002

OTHER PUBLICATIONS

International Search Report and Written Opinion issued in the related PCT Application PCT/US2016/063442, dated Mar. 7, 2017 (16 pages).

(Continued)

*Primary Examiner* — Giovanna Wright
(74) *Attorney, Agent, or Firm* — Cameron R. Sneddon

(57) ABSTRACT

An electronics component for use downhole includes a body having an outer surface. The outer surface includes a recess and a protrusion. A first shock absorber is positioned in the recess and compresses in a first direction with respect to the body. A second shock absorber is positioned adjacent to the protrusion and compresses in a second direction with respect to the body.

20 Claims, 3 Drawing Sheets

(51) Int. Cl.

| | |
|---|---|
| *E21B 43/116* | (2006.01) |
| *E21B 43/119* | (2006.01) |
| *E21B 47/06* | (2012.01) |
| *E21B 47/12* | (2012.01) |

(56) References Cited

U.S. PATENT DOCUMENTS

| | | | | |
|---|---|---|---|---|
| 5,320,169 | A * | 6/1994 | Delatorre | F16F 15/046 166/113 |
| 6,412,614 | B1 | 7/2002 | Lagrange et al. | |
| 6,439,055 | B1 | 8/2002 | Maron et al. | |
| 2005/0179748 | A1 | 8/2005 | Malik et al. | |
| 2006/0196676 | A1 | 9/2006 | Stoesz et al. | |
| 2011/0186284 | A1 | 8/2011 | Jekielek | |
| 2014/0151018 | A1 | 6/2014 | Lerche et al. | |
| 2014/0260591 | A1* | 9/2014 | Rodgers | E21B 47/017 73/152.58 |
| 2015/0252666 | A1 | 9/2015 | Wang et al. | |
| 2018/0155992 | A1* | 6/2018 | Brown | E21B 47/017 |

OTHER PUBLICATIONS

International Preliminary Report on Patentability issued in the related PCT Application PCT/US2016/063442, dated Jul. 3, 2018 (11 pages).

* cited by examiner

PERFORATING SHOCK PROTECTION FOR SENSORS

CROSS-REFERENCE TO RELATED APPLICATIONS

This application claims the benefit of a related U.S. Provisional Patent Application having Ser. No. 62/271,940, filed on Dec. 28, 2015, entitled "System for Downhole Tools Used with Explosives," the disclosure of which is incorporated by reference herein in its entirety.

BACKGROUND

The reliability of sensitive electronics in tools run downhole with a perforating string is a long-standing issue in the oilfield industry. For example, pressure sensors may be damaged by perforating shocks due to the fragile nature of the sensors and their internal connections. Such sensors may be protected from perforating shocks by placing a shock-absorbing sub between the sensors and the perforating guns. These shock-absorbing subs increase the length of the string in the wellbore, reduce the reliability of the string due to extra joints and seals that may flood, and increase cost.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An electronics component for use downhole is disclosed. The electronics component includes a body having an outer surface. The outer surface includes a recess and a protrusion. A first shock absorber is positioned in the recess and compresses in a first direction with respect to the body. A second shock absorber is positioned adjacent to the protrusion compresses in a second direction with respect to the body.

A downhole tool is also disclosed. The downhole tool includes a housing defining an internal volume. A body is positioned within the internal volume. A first shock absorber is positioned in a recess formed in an outer surface of the body. The first shock absorber attenuates shock transferred from the housing to the body in a radial direction. A second shock absorber attenuates shock transferred from the housing to the body in an axial direction.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the system and method disclosed herein may be practiced without these specific details.

Figure 1:
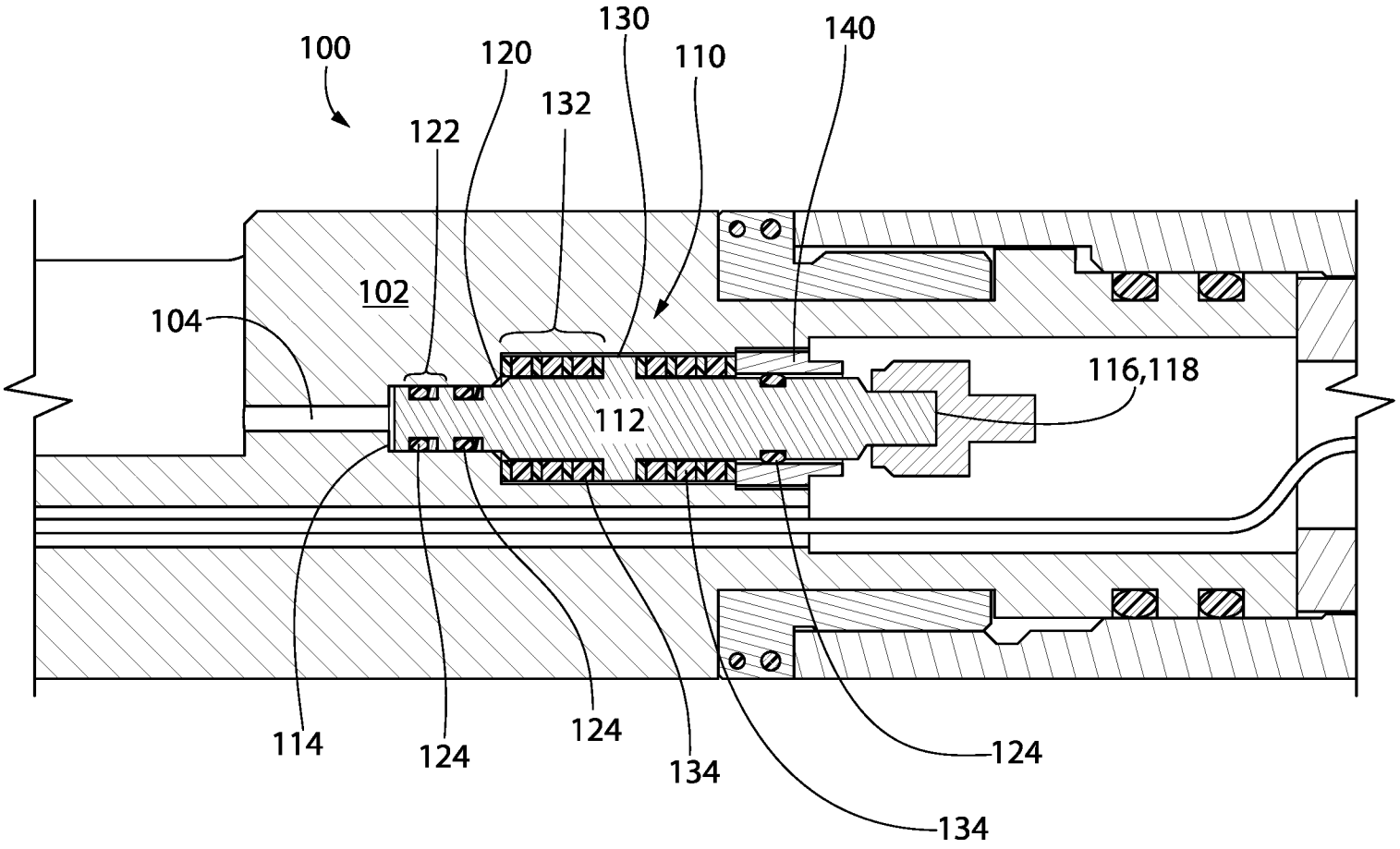
FIG. 1 illustrates a cross-sectional side view of a portion of a downhole tool having an electronics component positioned therein, according to an embodiment.

FIG. 1 illustrates a cross-sectional side view of a downhole tool 100 having an electronics component 110 positioned therein, according to an embodiment. The downhole tool 100 may be or include a measurement-while-drilling ("MWD") tool, a logging-while-drilling ("LWD") tool, a correlation tool, a perforation tool, a production logging tool, or the like. The downhole tool 100 may be part of and/or coupled to a drill string, a coiled tubing, a wireline, a slickline, or the like.

The downhole tool 100 may include a housing 102 that defines an internal volume. The electronics component 110 may be positioned within the internal volume of the housing 102. The electronics component 110 may be or include any electronics and/or hardware in the downhole tool 100 that may be sensitive to shock and vibration. For example, the electronics component 110 may be or include a sensor that is configured to measure one or more properties in a wellbore such as pressure, temperature, vibration, stress, strain, gamma rays, shock, flow, resistance, magnetic, electromagnetic, inclination, azimuth, torque, density, porosity, acoustic, or the like.

The electronics component 110 may include a body 112. The body 112 may be substantially cylindrical and have a first (e.g., upper) end 114 and a second (e.g., lower) end 116. The housing 102 of the downhole tool 100 may define a flow path 104 that, when open, places the first end 114 of the body 112 in fluid communication with fluid in the wellbore. This may allow the electronics component (e.g., sensor) 110 to measure, for example, the pressure of the fluid in the wellbore. The second end 116 of the body 112 may include an electrical connector 118 that is configured to engage a corresponding electrical connector 108 of the downhole tool 100. The electrical connection may supply power to the electronics component 110 and/or allow data transfer between the electronics component 110 and the downhole tool 100.

An outer (e.g., radial) surface 120 of the body 112 may define one or more recesses 122. The recesses 122 may extend radially-inward toward a central longitudinal axis of the body 112. As shown, the recesses 122 may be axially-offset from one another and extend at least partially (e.g., circumferentially) around the body 112. The recesses 122 may also or instead be circumferentially-offset from one another.

One or more first (e.g., radial) shock absorbers (three are shown: 124) may be positioned around the body 112. As shown, the first shock absorbers 124 may be positioned in the respective recesses 122. The first shock absorbers 124 may be made of a polymer that is configured to compress radially with respect to the body 112 to at least partially absorb or attenuate shock (e.g., from a perforating gun, pressure transients, etc.) that is transferred from the housing 102 to the body 112. The first shock absorbers 124 may compress radially down to about 20% to about 50% or about 50% to about 80% of their original thickness during a shock event and then return to their original thickness after the shock event is over. In at least one embodiment, the polymer may be an elastomer. For example, the first shock absorbers 124 may be or include elastomeric O-rings. The first shock absorbers 124 may also prevent wellbore fluids in the flow path 104 proximate to the first end 114 of the body 112 from reaching the electrical connector 118 at the second end 116 of the body 112.

The outer surface 120 of the body 112 may also include one or more protrusions/shoulders (one is shown: 130). The protrusion 130 may extend radially-outward away from the central longitudinal axis through the body 112. More particularly, the protrusion 130 may extend (e.g., radially) outward farther than a remainder of the outer surface 120 of the body 112. As shown, the protrusion 130 may be positioned axially-between two of the recesses 122. One or more voids/annuli (two are shown: 132) may be defined above the protrusion 130 and/or below the protrusion 130 and (e.g., radially) between the body 112 of and the housing 102. The voids 132 may be axially-offset from one another and extend at least partially (e.g., circumferentially) around the body 112.

One or more second (e.g., axial) shock absorbers (two are shown: 134) may be positioned around the body 112. As shown, the second shock absorbers 134 may be positioned in the respective voids 132. The second shock absorbers 134 may be or include a polymer (e.g., an elastomeric O-ring), a (e.g., metallic) spring, a washer, a sleeve, or a combination thereof that is configured to compress axially in one or both directions to at least partially absorb or attenuate shock (e.g., from a perforating gun, pressure transients, etc.) that transferred from the housing 102 to the body 112. An illustrative washer may be or include multiple different materials. The second shock absorbers 134 may compress down to about 20% to about 50% or about 50% to about 80% of their original axial length during a shock event and then return to their original axial length after the shock event is over.

Thus, as will be appreciated, the electronics component 110 may not be rigidly coupled to the housing 102 at any point. The first shock absorbers 124 may flexibly support the electronics component 110 in one direction (e.g., radially), and the second shock absorbers 134 may flexibly support the electronics component 110 in another direction (e.g., axially). Thus, the first and second directions may be substantially perpendicular to one another. In one embodiment, the electronics component 110 may not be in direct contact with the housing 102 at any point. For example, the first shock absorbers 124 may cause a (e.g., radial) gap to be formed between the body 112 and the housing 102 along the length of the electronics component 110, and the second shock absorbers 134 may cause an axial gap to be formed between the first end 114 of the body 112 and the housing 102 and/or between the second end 116 of the body 112 and the housing 102.

A retention member 140 may also be positioned in the internal volume of the housing 102. As shown, the retention member 140 may be positioned at least partially around the body 112 and axially-between the lower second shock absorber 134 and the housing 102. In at least one embodiment, the retention member 140 may contact the lower second shock absorber 134 but not the electronics component 110 itself (e.g., because one of the first shock absorbers 124 may be positioned radially-between the body 112 and the retention member 140). The body 112 may be compressed and supported by torqueing the retention member 140 down on the second shock absorbers 134. For example, the outer surface of the retention member 140 may be threaded into the inner surface of the housing 102. The retention member 140 may be a threaded nut, an epoxy, a welding material, or the like.

Figure 2:
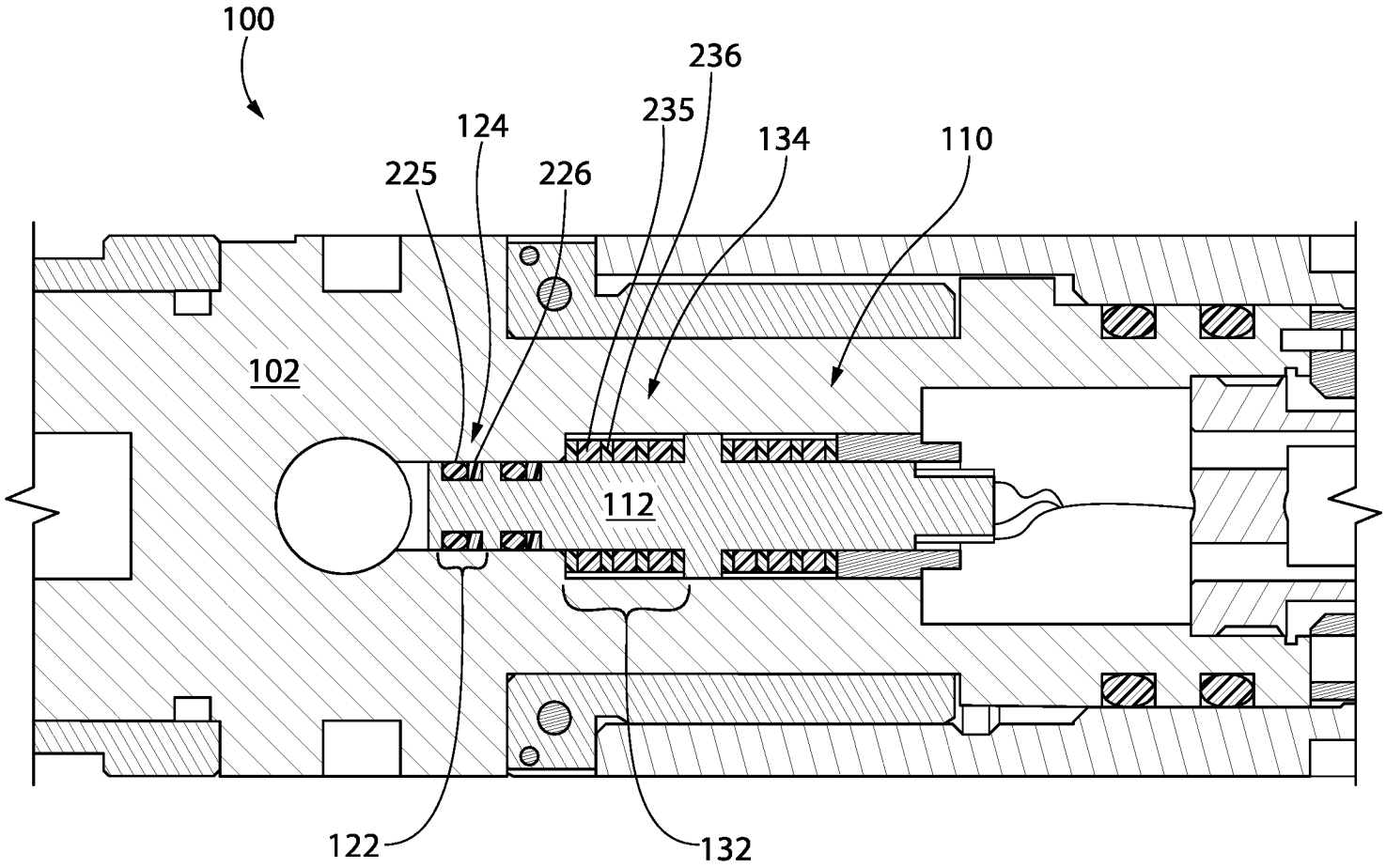
FIG. 2 illustrates a cross-sectional side view of another embodiment of the downhole tool having the electronics component positioned therein.

FIG. 2 illustrates a cross-sectional side view of another embodiment of the downhole tool 100 having the electronics component 110 positioned therein. The first shock absorber 124 may be or include one or more first rings 225 and one or more second rings 226 that are made of different materials. As shown, each recess 122 may have one first ring 225 and one second ring 226 that are positioned axially-adjacent to one another. The rings 225, 226 may be made of a polymer. In one example, the first ring 225 may be an elastomeric O-ring, and the second ring 226 may be a polyether ether ketone ("PEEK") backup ring. The second shock absorber 134 may be or include one or more first washers 235 and one or more second washers 236 that are made of different materials. As shown, each void 132 may have axially-alternating first and second washers 235, 236. In one example, the first washer 235 may be made of metal (e.g., brass), and the second washer 236 may be made of a polymer (e.g., PEEK). The body 112 may be compressed and supported by torqueing the retention member 140 down on the washers 235, 236.

Figure 3:
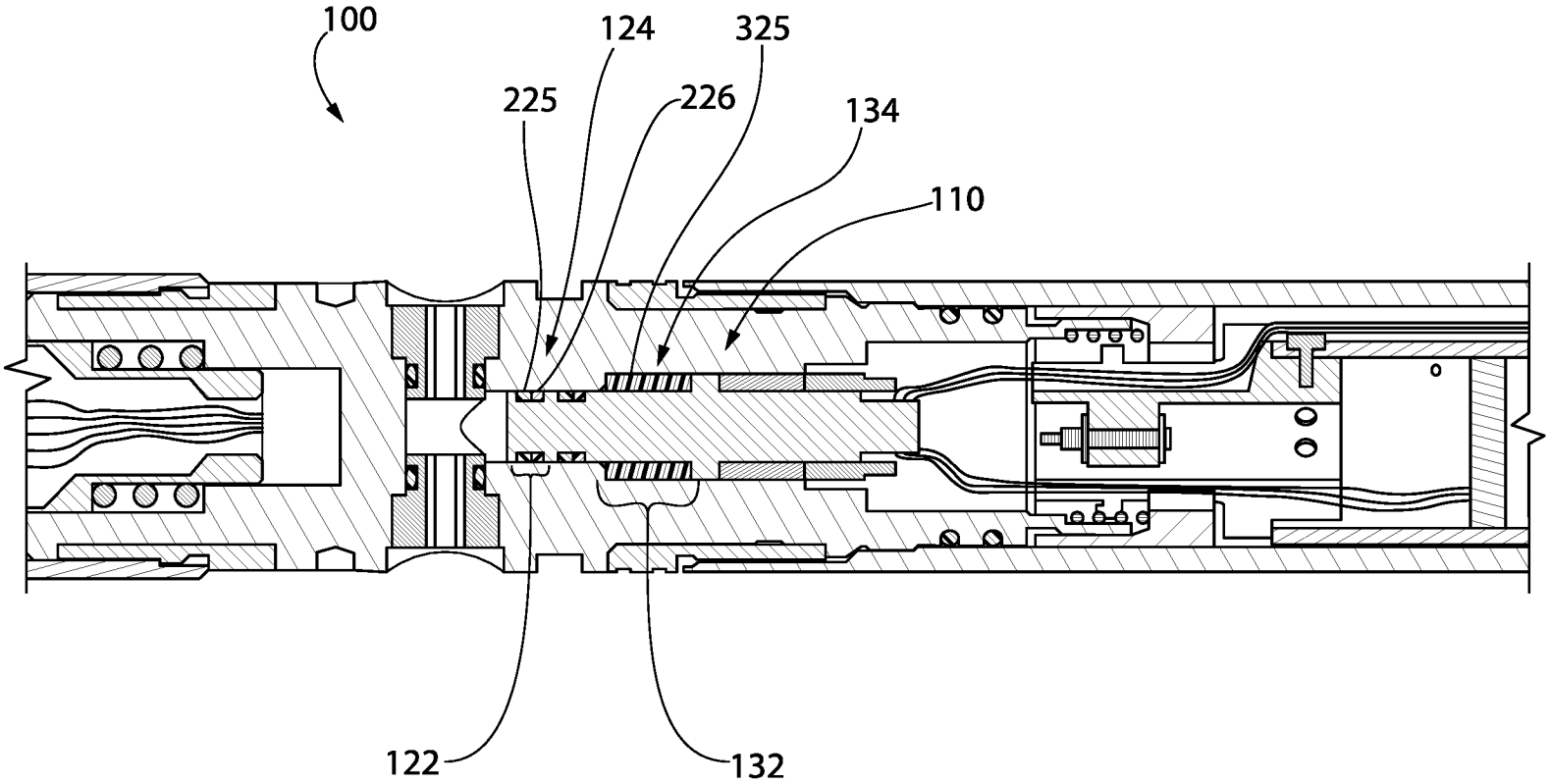
FIG. 3 illustrates a cross-sectional side view of yet another embodiment of the downhole tool having the electronics component positioned therein.

FIG. 3 illustrates a cross-sectional side view of yet another embodiment of the downhole tool 100 having the electronics component 110 positioned therein. The first shock absorber 124 may be or include the first ring(s) 225 and the second ring(s) 226 described above. The second shock absorbers 134 may be or include one or more isolation sleeves 325. As shown, each void 132 may have a sleeve 325 positioned therein. The isolation sleeve(s) 325 may be made of different metallic materials and/or polymers. The body 112 may be compressed and supported by torqueing the retention member 140 down on the sleeve(s) 325.

The first shock absorbers 124 in the recesses 122 and/or the second shock absorbers 134 in the voids 132 may be selected and installed based upon the materials of the shock absorbers 124, 134, the amount of shock/vibration that is expected, the sensitivity of the electronics component 110, or a combination thereof. In at least one embodiment, additional interfaces (e.g., recesses 122, protrusions 130) may be provided in/on the body 112, and/or the stiffness/durometer of the shock absorbers 124, 134 may be varied to create a tortuous path for the shock to be transmitted to the electronics component 110. The embodiments disclosed herein may allow for the omission of shock-absorbing subs between the electronics component 110 and a perforating gun positioned below (or above) the electronics component 110. In addition, buffer tubes may also be omitted, which may improve the performance of the electronics component 110 when taking high-frequency pressure measurements.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. An electronics component for use downhole, comprising:

a body having at least two recesses formed in an outer surface thereof;

a protrusion extending radially-outward from the outer surface, the protrusion extending outward farther than the outer surface portion of the body forming the recesses, the protrusion positioned axially between two of the recesses;

one or more first shock absorbers positioned in the at least two recesses and configured to compress in a first direction with respect to the body; and a second shock absorber positioned adjacent to the protrusion and configured to compress in a second direction with respect to the body, the second shock absorber positioned in one or more voids defined by the protrusion and the body.

2. The electronics component of claim 1, wherein the body is substantially cylindrical, wherein the recesses extend radially-inward toward a central longitudinal axis through the body, and wherein the protrusion extends radially-outward away from the central longitudinal axis.

3. The electronics component of claim 2, wherein the first shock absorber is configured to temporarily compress in a radial direction, and the second shock absorber is configured to temporarily compress in an axial direction, in response to shock from a perforating operation in a wellbore.

4. The electronics component of claim 1, wherein the first shock absorber comprises a polymer.

5. The electronics component of claim 4, wherein the first shock absorber comprises an O-ring.

6. The electronics component of claim 5, wherein the first shock absorber comprises a first O-ring and a second O-ring that are positioned axially-adjacent to one another, and wherein the first and second O-rings are made from different materials.

7. The electronics component of claim 3, wherein the second shock absorber comprises a spring.

8. The electronics component of claim 3, wherein the second shock absorber comprises a polymer.

9. The electronics component of claim 8, wherein the second shock absorber comprises first and second washers that are positioned axially-adjacent to one another, and wherein the first and second washers are made from different materials.

10. The electronics component of claim 3, further comprising a retention member that is configured to compress the second shock absorber, wherein a radial gap exists between the body and the retention member.

11. A downhole tool, comprising:

a housing defining an internal volume;

a body positioned within the internal volume, the body having an outer surface thereof;

one or more first shock absorbers positioned in at least two recesses formed in the outer surface of the body, wherein the one or more first shock absorbers are configured to attenuate shock transferred from the housing to the body in a radial direction;

a radial protrusion extending radially-outward from the outer surface and positioned axially between two of the recesses; and a second shock absorber configured to attenuate shock transferred from the housing to the body in an axial direction, the second shock absorber positioned adjacent the protrusion, the protrusion extending outward farther than the outer surface portion of the body forming the recesses, the second shock absorber positioned in one or more voids defined by the protrusion and the body and the housing.

12. The downhole tool of claim 11, wherein the body is not rigidly coupled to the housing.

13. The downhole tool of claim 12, wherein a circumferential gap exists between the body and the housing along an axial length of the body.

14. The downhole tool of claim 13, wherein a first axial gap exists between a first end of the body and the housing, and wherein a second axial gap exists between a second end of the body and the housing.

15. The downhole tool of claim 14, wherein the housing defines a flow path that, when open, places the first end of the body in fluid communication with fluid in a wellbore.

16. The downhole tool of claim 15, wherein the body comprises a sensor that is configured to measure a pressure of the fluid in the flow path.

17. The downhole tool of claim 11, wherein the second shock absorber comprises two shock absorbers with the radial protrusion positioned axially-therebetween.

18. The downhole tool of claim 17, further comprising a retention member that is configured to compress the second shock absorber, wherein a radial gap exists between the body and the retention member.

19. The downhole tool of claim 18, wherein the first shock absorber is positioned radially-between the body and the retention member.

20. The downhole tool of claim 18, wherein one of the two second shock absorbers is positioned axially-between the radial protrusion and the retention member.

* * * * *